United States Patent [19]

Verboom et al.

[11] Patent Number: 4,477,365

[45] Date of Patent: Oct. 16, 1984

[54] CAUSTIC BASED AQUEOUS CLEANING COMPOSITION

[75] Inventors: Gilles M. L. Verboom, Bolingbrook; Kenneth E. Bliznik, Dolton; Thomas L. Welsh, Downers Grove, all of Ill.

[73] Assignee: Miles Laboratories, Inc., Elkhart, Ind.

[21] Appl. No.: 526,952

[22] Filed: Aug. 29, 1983

Related U.S. Application Data

[63] Continuation-in-part of Ser. No. 455,946, Jan. 6, 1983, abandoned.

[51] Int. Cl.[3] ..... C11D 7/06

[52] U.S. Cl. ..... 252/156; 252/158; 252/526; 252/527; 252/545; 252/546; 252/556; 252/DIG. 14

[58] Field of Search ..... 252/156, 158, DIG. 14, 252/526, 545, 535, 537, 556

[56] References Cited

U.S. PATENT DOCUMENTS 4,421,680 12/1983 Shivar ..... 252/526

OTHER PUBLICATIONS

EP 68,352, English Abstract, WPIL Data Base.

*Primary Examiner*—Paul Lieberman
*Assistant Examiner*—Hoa Van Le
*Attorney, Agent, or Firm*—Jerome L. Jeffers

[57] ABSTRACT

Disclosed is a caustic based aqueous cleaning composition which is particularly suitable for use in cleaning soiled ovens. The composition, which has a viscosity of 200–2,000 centipoise at room temperature, comprises an alkali metal hydroxide, a fatty acid substituted betaine, a long-chain alpha olefin sulfonate and a hydrotropic agent.

24 Claims, No Drawings

CAUSTIC BASED AQUEOUS CLEANING COMPOSITION

BACKGROUND OF THE INVENTION

This application is a continuation-in-part of copending application Ser. No. 455,946, filed Jan. 6, 1983 now abandoned. The present invention is a caustic based, aqueous (solventless) cleaning composition which is particularly suited for removing soil from the inside of soiled ovens.

It has been known for many years that caustic based cleaning compositions are suitable for cleaning soiled ovens. For example, U.S. Pat. No. 4,157,921 entitled "Oven Cleaning Method and Composition" discloses a thixotropic caustic composition which contains sodium, potassium or lithium hydroxide, 2 thickeners, 1 of which is a thixotropic emulsion of a copolymer of acrylic acid and ethylene, an humectant and an organic solvent. This composition is designed to be delivered from a pump spray bottle and to solidify upon contact with the soiled surface.

In U.S. Pat. No. 4,099,985, there is disclosed an alkali metal hydroxide and a combination of an ethoxylated alcohol and a polyoxyethylene polypropylene copolymer as surfactants in aqueous solution. This composition is designed to gel when applied to a hot surface and revert to a liquid upon cooling to facilitate removal.

U.S. Pat. No. 3,829,387 discloses a caustic containing cleaning composition which comprises an alkali, a nonionic surfactant, water and from about 3% to about 20% by weight of a solvent comprising a mixture of 2 different phenyl glycol ethers of ethylene glycol, diethylene glycol or triethylene glycol.

In U.S. Pat. No. 3,779,933 entitled "Alkaline Oven Cleaning Composition", there is disclosed an alkali metal hydroxide and water solution having incorporated therein nitrogen-containing anionic surfactants combined with a polyhydric alcohol to form the active concentrate of a composition for cleansing food residue and soil from preheated surfaces of cooking ovens, grills and the like.

U.S. Pat. No. 3,715,324 involves a cleaning composition containing an aqueous or substantially aqueous mixture of sodium hydroxide, a dimethyl polysiloxane, tetrasodium pyrophosphate, a polyethylene oxide mono and/or dihydrogen phosphate ester, a nonyl phenol polyethylene glycol ether and triethanolamine. This highly caustic composition is designed for application to a hot surface, preferably one which is at a temperature above 200° F.

Crotty, et al, in U.S. Pat. No. 3,644,210, disclose a caustic cleaner containing alkali hydroxide, gluconate salts or gluconic acid, polyethoxylated alkanolamides, a detergent and N-fatty alkyl B-iminodipropionate.

A spray cleaning composition containing caustic, a surfactant and a mixture of furfuryl alcohol and tetrahydrofurfuryl alcohol as catalyzers is described in U.S. Pat. No. 3,335,092 as being useful for cleaning preheated oven surfaces.

Finally, the prior art includes a mixture of water, ammonia, an alkali-metal hydroxide and an aliphatic halogenated solvent suitable for cleaning food residues which mixture is disclosed in U.S. Pat. No. 3,296,147.

All of these compositions involve the use of organic solvents and/or require that the oven be preheated in order to be effective cleaners.

Two patents which do not relate to caustic based oven cleaning compositions, but which disclose compositions containing betaines, are U.S. Pat. No. 4,375,421 assigned to Lever Brothers Company and European Patent Publications No. 0,068,352 assigned to Hoechst AG.

SUMMARY OF THE INVENTION

The present invention is a caustic based, aqueous cleaning composition which comprises on a weight/weight basis of 100% active material:

(a) 7% to 10% of an alkali metal hydroxide;

(b) 0.1% to 2.0% of a fatty acid substituted betaine, amido betaine, sulfo betaine, amido sulfo betaine or a mixture thereof;

(c) 6% to 11% of one or a mixture of long-chain alpha olefin sulfonates; and (d) a hydrotropic agent whose chemical structure and concentration, in combination with ingredients (a), (b), and (c), are such as to provide the cleaning composition with a viscosity of 200 to 2,000 centipoise at room temperature.

DESCRIPTION OF THE INVENTION

The caustic cleaning composition described and claimed herein is both unique and highly effective and is based on the unexpected discovery that it is stabilized in the 200–2,000 centipoise viscosity range without a conventional thickener and is a highly effective oven cleaner which does not require the use of an organic solvent. When used to clean a soiled oven, it clings to the vertical and upper walls very satisfactorily, thus enhancing intimate contact between the cleaner and soil on all surfaces. Because it does not contain a conventional thickener such as starches, gums, or synthetic polymers, the detergent and caustic solution is readily available to penetrate and soften baked-on soil. Hence, cleaning is rapid and does not require preheating of the oven. Conventional thickeners tend to tie up water and thus retard the ability of cleaners containing them to penetrate hard crusts of baked-on soil. This retardation necessitates the use of heat or solvents to promote penetration. By contrast, the present composition is highly effective without solvents and does not require that the oven be preheated.

Suitable alkali metal hydroxides include sodium, potassium and lithium hydroxide with the sodium species being preferred. If desired, a mixture of these alkali metal hydroxides can be used.

The fatty acid substituted betaine can be characterized by the following structural formula:

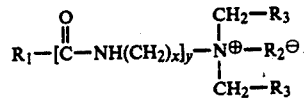

wherein y is 0 or 1, X is an integer of from 2 to 4, $R_1$ is a chain derived from a fatty acid containing from 8 to 18 carbon atoms, $R_2\ominus$ is either $CH_2COO\ominus$ or $CH_2$-$CHOH$-$CH_2SO_3\ominus$ and $R_3$ is independently H or —$CH_2OH$ provided that $R_3$ can be —$CH_2OH$ only when Y is 0 and $R_2\ominus$ is $CH_2COO\ominus$. The $R_1$ chain can be saturated as in the case of lauryl or unsaturated as in the case of oleyl. Examples of fatty acid substituted betaines suitable for use in the present invention are dimethyloleyl betaine, dimethyl-cocoyl betaine wherein $R_1$ is derived from coconut oil ($C_8$–$C_{18}$) and dimethyl-tallow betaine wherein $R_1$ is derived from tallow ($C_{14}$–$C_{18}$). Hydroxyethyl betaines corresponding to the foregoing formula where at least one $R_3$ group is —$CH_2OH$ have been found to be particularly effective for use in the present invention. Examples of hydroxyethyl betaines are those in which $R_1$ is derived from soybean oil, coconut oil, tallow or hydrogenated tallow. Suitable fatty acid substituted amido betaines include dimethylcocoamido betaine, dimethyloleylamido betaine, and dimethyl-tallow amido betaine. Suitable fatty acid substituted sulfo betaines and amido sulfo betaines include dimethylcocoyl sulfo betaine, dimethyl-oleyl sulfo betaine, dimethyl-cocoyl amido propyl sulfo betaine and dimethyl-oleyl amido propyl sulfo betaine. These compounds or mixtures thereof, in combination with the alpha olefin sulfonate, act as synergists which promote soil removal performance. Furthermore, they are instrumental in stabilizing the viscosity of the resulting composition in the range of 200 to 2,000 centipoise at room temperature. They can be used separately or in combination one with the other.

The long-chain alpha olefin sulfonate is characterized in that it is obtained from the sulfonation of an n-alpha olefin of the structure:

$$R—CH{=}CH_2$$

where R is an alkyl chain of 8 to 18 carbon atoms.

The alpha olefin sulfonate, in itself, is a degreasing agent and an emulsifier of fats and oils. Its function in the formulation is to promote caustic penetration of the soil. As it turns out, in combination with the betaine, the ability of the composition to cling to the vertical surfaces of the oven is promoted.

The 3 components described up to this point, i.e. the alkali metal hydroxide, betaine and alpha olefin sulfonate, at the recommended concentrations in water, result in a fluid of high viscosity with the appearance of a gel. To reduce the viscosity to a level suitable for application with a sponge, scrubber or pump spray, a fourth agent (hydrotropic agent) is needed. The hydrotropic agent is selected for its ability, in combination with the 3 components described above, i.e. the alkali metal hydroxide, betaine, and alpha olefin sulfonate to provide a viscosity within the range of 200–2,000 centipoise at room temperature and, preferably, to stabilize it in that range even when subjected to stressful environmental conditions such as heat (98° F.) and cold (6° F.). The cleaning composition of this invention is particularly suitable for use with the oven cleaning device disclosed in co-pending U.S. application Ser. No. 420,954 filed on Sept. 21, 1982. When used with this device, the preferred viscosity range of the present cleaning composition is 500 to 800 centipoise. In this range, the composition is easily applied with the device's scrubber pad and it clings to the vertical walls of the oven in sufficient quantities to perform its intended function. This viscosity range is also preferred for application with a sponge. For a pump spray, the preferred viscosity would be within the range of from 200 to 500 centipoise. When applying the cleaning composition with a sponge or scrubber, an increase in viscosity above 800 centipoise results in a tacky material and greater quantities (more than is really needed) are required just to cover the soiled surface. As the viscosity decreases below 500, the tendency to run (flow) down the vertical walls of the oven becomes more pronounced, resulting in a waste of product. However, a lower viscosity can be tolerated when a pump spray dispenser is used because the delivery rate per squeeze is such that the foregoing problems can be avoided unless the same area is repetitively covered with fluid.

Suitable hydrotropic agents include the class of phosphate ester hydrotropes such as those known in the art for their usefulness in high alkaline builder solutions. Suitable phosphate esters are commercially available under the trade names Triton H-66, Triton H-55 (Rohm & Hass Co.), and Gafac BG-510, GafAc RA-600 from GAF. Another class of hydrotropic agent which may be used is that of the tridecyl oxypoly (ethylenoxy) ethanols with a 9 to 15 mole ethylene oxide content per mole of tridecyl oxypoly ethanol. The preferred class of hydrotropic agent is that of the aromatic and polyaromatic sulfonates optionally substituted with 1 or more alkyl groups. The optional alkyl groups in these sulfonates may be methyl, ethyl, propyl or butyl. Further, these sulfonates can be in the form of their sodium or potassium salts with the sodium salts being preferred. Suitable compounds within this class include the sodium or potassium salts of xylene sulfonate, methyl napththalene sulfonate, cumene sulfonate or mixtures thereof. The preferred species is sodium methyl naphthalene sulfonate. The amount of hydrotropic agent required to provide a composition having the viscosity desired for its intended use will vary depending on the particular hydrotropic agent selected and the identity and concentration of the other ingredients in the composition. However, the amount required in any specific composition can be readily determined without undue experimentation by empirical viscosity testing using a standard Brookfield viscometer.

Optionally, a pigment will be added to the composition to provide opacity thereby adding visibility to the product during use. Any pigment which will provide the desired opacity and is not detrimentally reactive with the other ingredients is satisfactory; titanium dioxide is preferred. The rutile crystalline structure is particularly preferred because of its greater opacifying power in comparison to the anatase structure.

Optionally, a chelating agent will be added to the cleaning composition to stabilize the alkali metal hydroxide and inhibit possible flocculation arising from the presence of ions such as calcium, magnesium and iron as impurities in the water and the various raw materials. Suitable chelating agents include alkali-metal salts of ethylene diamine tetraacetic acid (EDTA), nitrilo triacetic acid (NTA) and gluconic acid.

An effective formulation for the presently described cleaning composition is set out in the following table I.

In the case where the betaine is mono- or dihydroxyethyl substituted, the preferred concentration is 1.2% to 1.8% by weight of the 100% active material.

TABLE I

| Component | % Active | % Weight/Weight | % on 100% Active Basis |
|---|---|---|---|
| Liquid Sodium Hydroxide | 50 | 18.4 | 8.9 to 9.5 |
| Alpha Olefin Sulfonate (Bioterge AS-40*) | 40 | 20 | 7.2 to 8.8 |
| Dimethyl Oleyl Betaine | 50 | 1.0 | 0.3 to 0.8 |

TABLE I-continued

| Component | % Active | % Weight/Weight | % on 100% Active Basis |
|---|---|---|---|
| (Mackam OB**) | | | |
| Methyl Naphthalene Sodium Sulfonate (Petro BA-95***) | 95 | 1.3 | 1.0 to 2.0 |
| Ethylene Diamine Tetra Acetate-Sodium Salt (Versene 100****) | 37 | — | 0 to 1.0 |
| Titanium Dioxide***** | 100 | 0.3 | 0 to 3 |
| Water | | q.s. 100 | q.s. 100 |

*Stepan Chemical Company
**McIntyre Chemical Company
***Petrochemical Company
****Dow Chemical Company
*****R-900 DuPont The method of preparing cleaning compositions falling within the scope of the present invention and their use in cleaning soiled surfaces are illustrated by the following examples.

EXAMPLE I

In this example, a 100 kilogram batch of the cleaning composition is prepared as follows:

(a) a premix was prepared in a small mixing tank by adding 3.8 kg (1.0 gal.) of water which was heated to 190° F. and adding 1 kg of dimethyl oleyl betaine. The water/betaine combination was mixed until the betaine dissolved and a homogeneous solution resulted whereupon 0.3 kg of titanium dioxide was added with further mixing to homogeneity.

(b) A 50 gallon mixing tank equipped with a bottom stirrer was used in the following preparation with constant mixing carried out at a speed slow enough to cause minimum vortex formation. First there was added 53 kg (14 gal.) of water with subsequent addition to the mixing tank of 20 kg of sodium alpha olefin sulfonate ($C_{14}$–$C_{16}$) and 1.0 kg naphthalene sulfonate. This combination was mixed until clear and the premix prepared as described above was added with the subsequent slow addition of 18.4 kg of a 50% solution of sodium hydroxide. The resultant was mixed until homogeneous, an additional 0.2 kg of naphthalene sulfonate was added with additional mixing to homogeneity and water was added q.s. to provide 23.5 gallons (100 kg) of product.

The viscosity of the product was found to be slightly over 1,000 centipoise at room temperature as determined by use of a standard Brookfield viscometer. This viscosity can readily be adjusted to any lower viscosity by adding small increments of methyl naphthalene sulfonate, typically in the amount of 0.025% wt/wt of the formulation, until the desired viscosity is reached.

EXAMPLE II

Additional formulations within the scope of the present invention were prepared as follows:

A premix was prepared by mixing 950 gms of 180° F. water and 50 gms of the betaine (50% active) in a Waring blender for about 15 minutes. In those compositions in which an opacifying agent was used, 15 gms of titanium dioxide was added and the mixing was continued until a homogeneous white solution was obtained.

In a 7.5 liter container there was mixed 2,005 gms of water, 1,000 gms of an alpha olefin sulfonate ($C_{14}$–$C_{16}$; 40% active) using a lightning mixer at moderate speed to avoid suds formation. To this solution there was added 45 gms of an aromatic sulfonate as hydrotropic agent with mixing until the solution was clear. The premix was added to this second solution and the combination mixed until it became homogeneous whereupon 920 gms of sodium hydroxide (50% active) was slowly added. The mixing rate was adjusted upwardly to maintain constant agitation as the viscosity increased during sodium hydroxide addition. After at least 15 minutes of mixing, 15 gms more aromatic sulfonate was added and mixing was continued for an additional 15 minutes. The resulting composition was allowed to cool overnight and the viscosity adjusted the next day by the addition of small additional increments of the aromatic sulfonate as hydrotropic agent (methyl napththalene sodium sulfonate in runs 1-5 and 8 and a modified polyalkyl polynuclear metallic sulfonate in runs 6 and 7).

In run 7, 5 gms of EDTA was added with the alpha olefin sulfonate.

The contents of these formulations and their viscosity performance under thermal stress are set out in table II where percentages are on a wt/wt basis. Formulations I through VIII were evaluated in terms of soil removal from soiled porcelain oven tiles using a method derived from the CSMA procedure for oven cleaner evaluation*. The formulations provided good to excellent cleaning ability. The viscosity data are indicative of the stability of the product when submitted to stressing environmental conditions. The 3 cycles of freeze-thaw is particularly rigorous as the product is repetitively brought to a frozen state and subsquently thawed to room temperature.

*Chemical Speciality Manufacturer's Association Method Development Task Force, Proposed Method 1981.

TABLE II

| | % Active | I | II | III | IV | V | VI | VII | VIII |
|---|---|---|---|---|---|---|---|---|---|
| Liquid Sodium Hydroxide | 50 | 18.4% | 18.7% | 18.4% | 18.4% | 18.4% | 18.4% | 18.4% | 18.4% |
| Alpha Olefin Sulfonate Sodium Salt ($C_{14}$–$C_{16}$) | 40 | 20.0 | 20.0 | 26.0 | 20.0 | 20.0 | 22.0 | 20.0 | 20.0 |
| Dimethyl Oleyl Betaine | 50 | 1.0 | 1.0 | 1.0 | 1.0 | — | — | — | — |
| Dimethyl Oleyl Amido Propyl Betaine | 30 | — | — | — | — | 2.0 | 1.5 | 1.0 | — |
| Dimethyl Cocoyl Amido Propyl Hydroxy Sulfo Betaine | 30 | — | — | — | — | — | — | — | 5.0 |
| Methyl Naphthalene Sodium Sulfonate | 95 | 1.4 | 1.5 | 1.0 | 1.3 | 1.0 | — | — | 1.5 |
| Modified Polyalkyl Polynuclear | 95 | — | — | — | — | — | 1.5 | 1.0 | — |

TABLE II-continued

| | % Active | I | II | III | IV | V | VI | VII | VIII |
|---|---|---|---|---|---|---|---|---|---|
| Metallic Sulfonate* | 100 | 0.3 | 0.5 | 0.5 | 0.5 | 0.5 | — | 0.5 | — |
| Titanium Dioxide (optional) | 37 | — | — | — | — | — | — | 0.1 | — |
| EDTA, Sodium Salt (optional) | | water q.s. | 100% | | | | | | |
| Water | | 600 | 650 | 950 | 750 | 1460 | 1150 | 600 | 700 |
| Initial Viscosity at 72° F. | | 600 | 660** | 700 | 800 | 1160 | 1100 | 400 | 600 |
| Viscosity after 3 freeze-thaw cycles at 72° F. | | — | 640 | — | 750 | — | 1050 | — | — |
| Viscosity after 1 month in 98° F. environment, at 72° F. | | | | | | | | | |

*Petro BAF (Petrochemical Company)
**Viscosity at 72° F., after 1 month at 36° F.

EXAMPLE III

A 100 kg batch of a composition corresponding to the present invention in which there was used a dihydroxyethyl betaine was prepared by the following technique.

In a mixing tank equipped with a bottom stirrer, the following ingredients were added successively while mixing thoroughly with minimum vortex formations:

(A) 20 kg of hot (140°–180° F.) water and 4.3 kg of dihydroxyethyl tallow betaine were combined with mixing until the betaine dissolved in the water.

(B) 34.3 kg of water, 19.9 kg of alpha olefin sulfonate and 2.0 kg of methyl napththalene sulfonate were then added with mixing until dissolution was achieved.

(C) 0.3 kg of titanium dioxide was added with mixing to homogeneity.

(D) At this point, there was slowly added 18.3 kg of a 50% active sodium hydroxide solution with thorough mixing.

(E) An amount of methyl naphthalene sulfonate necessary to achieve the desired viscosity is added with thorough mixing.

The batch viscosity adjustment of step E is carried out by first weighing out 1000 gm of the in process material into a 1,500 ml beaker batch and cooling it to 72°±2° F. At this point (step 1), the viscosity is checked with a Brookfield viscometer at 72°±2° F. If the viscosity is greater than 800 cps., there is added 1.0±0.05 gm of methyl naphthalene sulfonate (step 2) and steps 1 and 2 are repeated (step 3) until the viscosity is in the specified range (500 to 800 cps. at 72° F. in this case). The viscosity is rechecked with a new 1,000 gm sample of the in process batch to which is added the total quantity of methyl naphthalene sulfonate added in steps 2 and 3.

The amount of methyl naphthalene sulfonate to be added to the production batch is calculated as follows:

$$\text{Methyl Naphthalene Sulfonate (pounds)} = \frac{\text{No. gms Methyl Naphthalene Sulfonate added to 1000 gm sample to adjust viscosity}}{1000} \times \text{Batch Wt (Lbs) from load cell}$$

The following table III provides the preferred formulation when a dihydroxyethyl betaine is used.

TABLE III

| Component | % Active | % Weight/Weight | % on 100% Active Basis |
|---|---|---|---|
| Liquid Sodium Hydroxide | 50 | 18.4 | 8.9 to 9.5 |
| Alpha Olefin Sulfonate (Bioterge AS-40*) | 40 | 20 | 7.2 to 8.8 |
| Dihydroxyethyl Tallow Betaine (Mirataine T.M.) | 35 | 4.3 | 1.2 to 1.8 |
| Methyl Naphthalene Sodium Sulfonate (Petro BA-95***) | 95 | 2.3 | 1.0 to 3.0 |
| Ethylene Diamine Tetra Acetate-Sodium Salt (Versene 100****) | 37 | — | 0 to 1.0 |
| Titanium Dioxide***** | 100 | 0.3 | 0 to 3 |
| Water | | q.s. 100 | q.s. 100 |

*Stepan Chemical Company
**Miranol Chemical Company
***Petrochemical Company
****Dow Chemical Company
*****R-900 DuPont This invention is a novel liquid oven cleaning composition stabilized in the viscosity range of 200 to 2,000 centipoise at room temperature. It is an effective and quick acting liquid cleaner with a high caustic content that clings to the oven walls without the need for conventional thickeners. As a result, it is easily and efficiently applied with a sponge, a scrubber or a pump spray, avoiding the messiness inherent in the brush application of viscous gels. Because of the relatively low viscosity and the special surfactant blend, the material can penetrate soils effectively and achieve a better soil contact than gels or foams.

The composition is extremely effective and contains only alkali, surfactants, a hydrotropic agent (optionally a pigment and/or a chelating agent) and water. An organic solvent is not required, and as a result, the composition does not generate irritating organic fumes or vapors while in use.

What is claimed is:

1. A caustic based, aqueous cleaning composition which comprises on a weight/weight basis of 100% active material:

(a) 7% to 10% of an alkali metal hydroxide;

(b) 0.1% to 2.0% of a fatty acid substituted betaine, amido betaine, sulfo betaine, amido sulfo betaine or a mixture thereof;

(c) 6% to 11% of one or a mixture of longchain alpha olefin sulfonates; and (d) a hydrotropic agent whose chemical structure and concentration are such as, in combination with ingredients (a), (b), and (c), to provide the cleaning composition with a viscosity of 200 to 2,000 centipoise at room temperature.

2. The composition of claim 1 wherein the betaine is characterized by the formula:

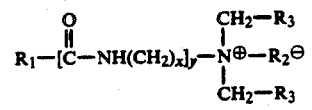

wherein y is 0 or 1, x is an integer from 2 to 4, $R_1$ is a chain derived from a fatty acid containing from 8 to 18 carbon atoms, $R_2\ominus$ is either $CH_2COO\ominus$ or $CH_2$-$CHOH$-$CH_2SO_3\ominus$ and $R_3$ is independently H or —$CH_2OH$ provided that $R_3$ can be —$CH_2OH$ only when y is 0 and $R_2\ominus$ is $CH_2COO\ominus$.

3. The composition of claim 2 wherein the $R_1$ chain is cocoyl, oleyl or talloyl and y is 0.

4. The composition of claim 3 wherein $R_2$ is $CH_2COO\ominus$.

5. The composition of claim 3 wherein $R_2$ is $CH_2$-$CHOH$-$CH_2SO_3$63.

6. The composition of claim 2 wherein the $R_1$ chain is cocoyl, oleyl or talloyl, y is 1 and x is 3.

7. The composition of claim 6 wherein $R_2$ is $CH_2COO\ominus$.

8. The composition of claim 6 wherein $R_2$ is $CH_2$-$CHOH$-$CH_2SO_3\ominus$.

9. The composition of claim 2 wherein $R_1$ is talloyl, y is 0, $R_3$ is —$CH_2OH$ and $R_2$ is $CH_2COO\ominus$.

10. The composition of claim 2 wherein at least one $R_3$ is —$CH_2OH$.

11. The composition of claim 9 wherein $R_1$ is derived from soybean oil, coconut oil, tallow or hydrogenated tallow.

12. The composition of claim 9 wherein both $R_3$ moieties are —$CH_2OH$ and $R_1$ is talloyl.

13. The composition of claim 1 wherein the longchain alpha olefin sulfonate is characterized in that it is obtained from the sulfonation of an n-alpha olefin of the structure:

$$R—CH=CH_2$$

wherein R is an alkyl chain of 8 to 18 carbon atoms or a mixture thereof.

14. The composition of claim 1 wherein the hydrotropic agent is a phosphate ester; a tridecyl oxypoly(ethylenoxy) ethanol with an ethylene oxide content of 9 to 15 moles per mole of tridecyl epoxy ethanol or an aromatic or polyaromatic sulfonate optionally substituted with 1 or more alkyl groups containing 1 to 4 carbon atoms or a sodium or potassium salt thereof.

15. The composition of claim 14 wherein the hydrotropic agent is sodium xylene sulfonate, sodium methyl naphthalene sulfonate, sodium cumene sulfonate or a mixture thereof.

16. The composition of claim 1 to which is added an opacifying pigment.

17. The composition of claim 16 wherein the opacifying pigment is rutile titanium dioxide.

18. The composition of claim 1 to which is added up to 1% by weight of chelating agent.

19. A caustic based, aqueous cleaning composition which comprises on a weight/weight basis of 100% active material:

(a) from 8.9% to 9.5% sodium hydroxide;

(b) from 7.2% to 8.8% of an alpha olefin sulfonate or a mixture of alpha olefin sulfonates obtained from the sulfonation of an n-alpha olefin of the formula:

$$R—CH=CH_2$$

wherein R is an alkyl chain of 8 to 18 carbon atoms;

(c) from 0.3% to 0.8% of a dimethyl betaine or from 1.2% to 1.8% of a mono- or dihydroxyethyl substituted betaine; and (d) from 1.0% to 3.0% of methyl naphthalene sodium sulfonate.

20. The composition of claim 19 wherein the amount of methyl naphthalene sodium sulfonate is that amount which, in combination with the sodium hydroxide, alpha olefin sulfonate and betaine, is sufficient to provide a composition having a viscosity of 500 to 800 centipoise.

21. The composition of claim 19 to which is added up to 3.0% of rutile titanium dioxide as opacifying agent.

22. The composition of claim 19 to which is added up to 1.0% of sodium ethylene diamine tetra acetate as a chelating agent.

23. The composition of claim 20 wherein the betaine is dimethyl oleyl betaine.

24. The composition of claim 20 wherein the betaine is dihydroxyethyl tallow betaine.

* * * * *

UNITED STATES PATENT OFFICE

CERTIFICATE OF CORRECTION

Patent No. 4,477,365 Dated October 16, 1984

Inventor(s) Gilles M. L. Verboom et al

It is certified that error appears in the above-identified patent and that said Letters Patent are hereby corrected as shown below:

Column 4, Line 17, insert ---or--- between "BG-510" and "GafAc-600".

Column 9, Line 31, change "$CHOH-CH_2SO_3$ 63" to ---$CHOH-CH_2SO_3^{\ominus}$---.

Signed and Sealed this

Fourteenth Day of May 1985

[SEAL]

Attest:

DONALD J. QUIGG

Attesting Officer

Acting Commissioner of Patents and Trademarks